US010519751B2

(12) United States Patent
Kusmer et al.

(10) Patent No.: US 10,519,751 B2
(45) Date of Patent: Dec. 31, 2019

(54) APPARATUS AND METHODS FOR REGULATING COMPONENT TEMPERATURE IN A DOWNHOLE TOOL

(71) Applicant: Vierko Enterprises, LLC, Houston, TX (US)

(72) Inventors: Daniel Philip Kusmer, Meadows City, TX (US); Nicolas Alejandro Wolk, Houston, TX (US)

(73) Assignee: VIERKO ENTERPRISES, LLC, Houston, TX (US)

( * ) Notice: Subject to any disclaimer, the term of this patent is extended or adjusted under 35 U.S.C. 154(b) by 86 days.

(21) Appl. No.: 15/647,373

(22) Filed: Jul. 12, 2017

(65) Prior Publication Data

US 2019/0017350 A1 Jan. 17, 2019

(51) Int. Cl.

| | |
|---|---|
| ***E21B 36/00*** | (2006.01) |
| ***E21B 47/06*** | (2012.01) |
| ***E21B 47/01*** | (2012.01) |

(52) U.S. Cl.

CPC ..... *E21B 36/001* (2013.01); *E21B 47/011* (2013.01); *E21B 47/065* (2013.01)

(58) Field of Classification Search

CPC ..... E21B 36/001
USPC ..... 166/302
See application file for complete search history.

(56) References Cited

U.S. PATENT DOCUMENTS

| | | | |
|---|---|---|---|
| 6,336,408 B1 | 1/2002 | Parrott et al. | |
| 2006/0102353 A1 | 5/2006 | Storm et al. | |
| 2011/0272154 A1 | 11/2011 | Kaul et al. | |
| 2012/0048531 A1 | 3/2012 | Marzouk et al. | |
| 2013/0148300 A1 | 6/2013 | Hovik | |
| 2016/0123484 A1* | 5/2016 | Mori | F16K 15/08 137/512 |

* cited by examiner

*Primary Examiner* — Taras P Bemko
(74) *Attorney, Agent, or Firm* — Jonathan M. Pierce; Porter Hedges LLP

(57) ABSTRACT

A downhole tool includes a component that may require thermal management and a thermostat. The thermostat is used to thermally couple or decouple the component from an environment of the downhole tool. The thermostat includes a first solid thermal conductor, a second solid thermal conductor, and an actuator mechanically coupled to the first and/or the second solid thermal conductor. The actuator is adapted to move the second solid thermal conductor relative to the first solid conductor in response to temperature.

14 Claims, 6 Drawing Sheets

APPARATUS AND METHODS FOR REGULATING COMPONENT TEMPERATURE IN A DOWNHOLE TOOL

CROSS-REFERENCE TO RELATED APPLICATIONS

None

BACKGROUND

Generally, this disclosure relates to thermal management of downhole tools. More particularly, this disclosure relates to thermostats for downhole tools and methods of using the same.

A Dewar flask is a passive device that is often used in a downhole tool for maintaining the temperature of sensitive components. It is very efficient at keeping the heat of the wellbore environment out of the cavity formed in it. For this reason, it is advantageously used in hot portions of wellbores. It allows the downhole tool to remain in the wellbore for longer durations before the sensitive components located in its cavity reach their maximum temperature limitation.

However, a Dewar flask also keeps the heat inside its cavity, even in cold portions of wellbores. If components located inside the cavity are generating heat, the heat may not dissipate in the cold portions of the wellbores, causing its inside temperature to progressively increase. Accordingly, in cases where the components dissipate heat, the duration during which the downhole tool may remain in the wellbore before the components located inside the cavity reach the maximum temperature limitation may be shortened. In such cases, the downhole tool is often tripped out of the wellbore, either for cooling the Dewar flask down to a suitable temperature or for replacing the Dewar flask with another one already at a suitable temperature. Then, the downhole tool is tripped back in the wellbore. This tripping of the downhole tool may waste much rig time, be a costly operation, and be potentially performed in hazardous conditions.

A conventional method to mitigate the temperature increase in a Dewar flask may be to refrigerate the Dewar flask and the components located in its cavity to a temperature lower than the ambient temperature prior to tripping the downhole tool into the wellbore. However, this method may not be suitable in cases where one or more of the components located inside the Dewar flask has a minimum operating temperature that is close to or above the ambient temperature. Gyroscopes may be an example of such components. Gyroscopes are typically used in survey tools. Many gyroscopes have a temperature range, for example between 70 deg. F. and 260 deg. F., where they operate optimally.

Another conventional method to mitigate the increase of temperature in a Dewar flask may involve selectively cooling the components located in its cavity. For example, upon detecting that one or more of the components has reached a maximum temperature limitation, a fluid may be circulated to transport heat from the cavity to the wellbore environment, or an active cooler may be turned on. However, this method may require a relatively complex and heavy circulation system or an active cooler that consumes electrical power to provide heat transfer. The added complexity and weight may not be suitable for downhole tools conveyed via slickline or wireline.

Thus, there is a continuing need in the art for thermal management of downhole tools.

BRIEF SUMMARY OF THE DISCLOSURE

The disclosure describes downhole tools that comprise a first solid thermal conductor, a second solid thermal conductor, and an actuator mechanically coupled to at least one of the first solid thermal conductor and the second solid thermal conductor. The second solid thermal conductor is movable relative to the first solid thermal conductor: in a first position, the second solid thermal conductor is in contact with the first solid thermal conductor, and in a second position, the second solid thermal conductor is separated from the first solid thermal conductor by a gap.

The actuator is adapted to move the second solid thermal conductor relative to the first solid thermal conductor between the first position and the second position in response to temperature. For example, the actuator may comprise an electromechanical solenoid, a hydraulic or pneumatic piston piloted with valves, a motor driven by a controller that is communicatively coupled to one or more temperature sensors, a thermal actuator including a sealed wax charge and a piston, a thermally expandable material, a shape-memory material, or a bimetallic strip. The second solid thermal conductor and the first solid thermal conductor may be in the first position when the temperature is within a first preselected range. In the first position, a contact surface of the second solid thermal conductor with the first solid thermal conductor has a first non-zero area. Accordingly, in the first position, the second solid thermal conductor may be efficiently thermally coupled to the first solid thermal conductor. Conversely, the second solid thermal conductor and the first solid thermal conductor may be in the second position when the temperature is within a second preselected range, which may not overlap with the first preselected range. In the second position, the gap separating the second solid thermal conductor from the first solid thermal conductor may provide a suitable thermal insulation between the second solid thermal conductor and the first solid thermal conductor.

Also, the second solid thermal conductor is thermally coupled to a component of the downhole tools, and the first solid thermal conductor is thermally coupled to an elongated pressure housing of the downhole tools. For example, the second solid thermal conductor may be fixedly attached to a chassis on which the component of the downhole tools is mounted, and/or the first solid thermal conductor may be fixedly attached to the elongated pressure housing of the downhole tools. As such, the actuator may selectively, based on the temperature, thermally couple the component of the downhole tools and an environment of the elongated pressure housing.

Preferably, the downhole tools may comprise a thermally insulating flask, such as a Dewar flask, disposed in the elongated pressure housing. The flask has an opening and a cavity. The component of the downhole tools may be disposed in the cavity of the flask. The second solid thermal conductor and/or the first solid thermal conductor may be disposed at least partially in the opening of the flask. Thus, the efficient heat paths between the component and the environment of the elongated pressure housing may only run through the second solid thermal conductor and the first solid thermal conductor. Accordingly, the position of the second solid thermal conductor relative to the first solid thermal conductor may essentially determine whether the component of the downhole tools and the environment of the elongated pressure housing are thermally insulated.

In some embodiments, the second solid thermal conductor may optionally be movable relative to the first solid thermal conductor to a third position, which may be any intermediate between the first and second positions. In the third position, the second solid thermal conductor may still be in contact with the first solid thermal conductor. However, the contact surface of the second solid thermal conductor with the first solid thermal conductor in the third position has a second non-zero area that may be smaller than the first non-zero area.

In some embodiments, the first solid thermal conductor may optionally be movable relative to the elongated pressure housing. An area of a contact surface of the first solid thermal conductor with the elongated pressure housing may increase gradually or stepwise with a change of position of the first solid thermal conductor relative to the elongated pressure housing.

In some embodiments, the downhole tools may optionally comprise metal bellows encasing the contact surface of the second solid thermal conductor with the first solid thermal conductor in a vacuum chamber. Further, the contact surface of the second solid thermal conductor with the first solid thermal conductor may optionally include a silver plating. Furthermore, the downhole tools may optionally comprise a reflective tube surrounding the contact surface of the second solid thermal conductor with the first solid thermal conductor. As such, heat radiation, convection or diffusion across the gap separating the second solid thermal conductor from the first solid thermal conductor and/or toward the second solid thermal conductor may be essentially suppressed when the second solid thermal conductor is separated from the first solid thermal conductor by the gap.

The disclosure also describes methods of assembling and using downhole tools. Assembling the downhole tools may involve thermally coupling a first solid thermal conductor to an elongated pressure housing of the downhole tools, thermally coupling a second solid thermal conductor to a component of the downhole tools, and mechanically coupling an actuator to at least one of the second solid thermal conductor and the first solid thermal conductor. Using the downhole tools may involve tripping the downhole tools in a wellbore while maintaining a gap separating the second solid thermal conductor from the first solid thermal conductor, and moving, using the actuator, the second solid thermal conductor into contact with the first solid thermal conductor in response to a temperature of the component that is higher than a first predetermined temperature threshold. Preferably, the methods may further comprise reestablishing the gap separating the second solid thermal conductor from the first solid thermal conductor in response to the temperature of the component that is lower than a second predetermined temperature threshold. Accordingly, the temperature of the component may be maintained in a suitable range where the component may operate optimally.

To ensure that an environment of the elongated pressure housing of the downhole tools is sufficiently cool when the second solid thermal conductor is in contact with the first solid thermal conductor, the methods may further comprise tripping the downhole tools to a cold section of the wellbore such as near a seafloor, which is a location along the wellbore where the environment of the elongated pressure housing is usually the coldest, prior to moving the second solid thermal conductor into contact with the first solid thermal conductor. Alternatively, the methods may further include circulating a cold wellbore fluid along the elongated pressure housing after moving the second solid thermal conductor into contact with the first solid thermal conductor. Alternatively or additionally the methods may involve moving the second solid thermal conductor into contact with the first solid thermal conductor in response to a temperature of an environment of the elongated pressure housing that is lower than a third predetermined temperature threshold.

In some embodiments, the methods may optionally comprise gradually varying an area of a contact surface of the second solid thermal conductor with the first solid thermal conductor in response to the temperature of the component. Accordingly, the temperature of the component may be more finely adjusted.

The disclosure also describes downhole tools comprising a first solid thermal conductor, a second solid thermal conductor thermally coupled to a component of the downhole tools, and a third solid thermal conductor thermally coupled to an elongated pressure housing of the downhole tools. The first solid thermal conductor is movable relative to the second solid thermal conductor and the third solid thermal conductor. The downhole tools further comprise at least one actuator mechanically coupled to the first solid thermal conductor. The actuator is adapted to move the first solid thermal conductor relative to the second solid thermal conductor and the third solid thermal conductor between a first position and a second position in response to temperature. In the first position, the first solid thermal conductor is in contact with the second solid thermal conductor and the third solid thermal conductor. In the second position, the first solid thermal conductor is at least partially separated from the second solid thermal conductor by a first gap and from the third solid thermal conductor by a second gap.

In some embodiments, the downhole tools may optionally comprise another actuator mechanically coupled to the second solid thermal conductor, the other actuator being adapted to move the second solid thermal conductor relative to the first solid thermal conductor in response to a temperature of the component of the downhole tools.

BRIEF DESCRIPTION OF THE DRAWINGS

For a more detailed description of the embodiments of the disclosure, reference will now be made to the accompanying drawings, wherein.

DETAILED DESCRIPTION

Figure 1:
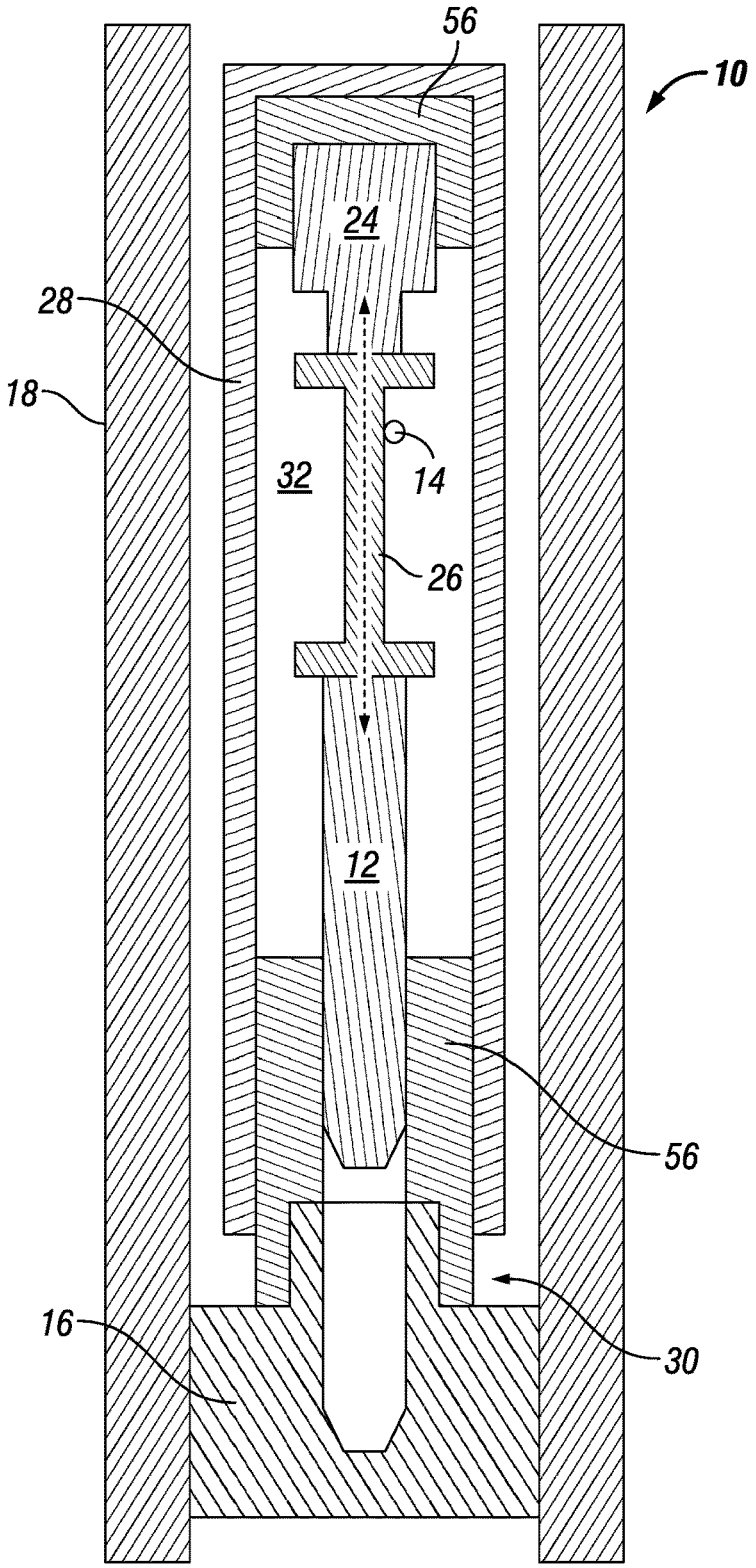
FIG. 1 is a sectional view of a downhole tool including a thermostat.

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention. Additionally, the disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Finally, the exemplary embodiments presented below may be combined in any combination of ways, i.e., any element from one exemplary embodiment may be used in any other exemplary embodiment, without departing from the scope of the disclosure.

All numerical values in this disclosure may approximate values unless otherwise specifically stated. Accordingly, various embodiments of the disclosure may deviate from the numbers, values, and ranges disclosed herein without departing from the intended scope. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function.

Referring initially to FIGS. 1, and 2A-2C, a downhole tool 10 comprises an elongated pressure housing 18, a component 14, and a thermostat that may be used to thermally couple or decouple the component 14 of the downhole tool 10 from an environment of the elongated pressure housing 18. The thermostat includes a first solid thermal conductor 16, a second solid thermal conductor 12, and an actuator 24 mechanically coupled to the second solid thermal conductor 12, for example as shown, indirectly through a chassis 26. The first solid thermal conductor 16 may be implemented with a large heat sink having a cavity therein. The second solid thermal conductor may be implemented with a rod configured to snuggly reciprocate within the cavity of the large heat sink. Also, the second solid thermal conductor 12 may be thermally coupled to the component 14 of the downhole tool 10 via the chassis 26, and the first solid thermal conductor 16 may be thermally coupled to an elongated pressure housing 18 of the downhole tools via direct contact.

The chassis 26 and the second solid thermal conductor 12 are movable, and the actuator 24 is adapted to move the chassis 26 and the second solid thermal conductor 12 in response to temperature. In a first position illustrated in FIG. 2A, the second solid thermal conductor 12 is in contact with the first solid thermal conductor 16, and in a second position illustrated in FIG. 2C, the second solid thermal conductor 12 is separated from the first solid thermal conductor 16 by a gap 22.

The second solid thermal conductor 12 may be in the first position when a temperature, such as the temperature of component 14, is within a first preselected range. In the first position illustrated in FIG. 2A, a contact surface 20 of the second solid thermal conductor 12 with the first solid thermal conductor 16 has a first non-zero area. Accordingly, in the first position, the second solid thermal conductor 12 may be efficiently thermally coupled to the first solid thermal conductor 16, as shown by heat path 54.

Conversely, the second solid thermal conductor 12 may be in the second position when the temperature is within a second preselected range that does not overlap with the first preselected range. In the second position illustrated in FIG. 2C, the gap 22 separating the second solid thermal conductor 12 from the first solid thermal conductor 16 may provide a suitable thermal insulation between the second solid thermal conductor 12 and the first solid thermal conductor 16.

The downhole tool 10 further comprises a flask 28 that is thermally insulating, such as a Dewar flask, disposed in the elongated pressure housing 18. The flask 28 has a cavity 32, and an opening 30 partially obstructed by an insulator 56. The component 14 may be disposed in the cavity 32 of the flask 28. The second solid thermal conductor 12 and/or the first solid thermal conductor 16 may be disposed at least partially in the opening 30 of the flask 28 and through the insulator 56. Thus, the efficient heat path 54 between the component 14 and the environment of the elongated pressure housing 18 may only run through the first solid thermal conductor 16 and the second solid thermal conductor 12. Accordingly, the position of the second solid thermal conductor 12 relative to the first solid thermal conductor 16 may essentially determine whether the component 14 of the downhole tool 10 and the environment of the elongated pressure housing 18 are thermally coupled or insulated.

Figure 2A:
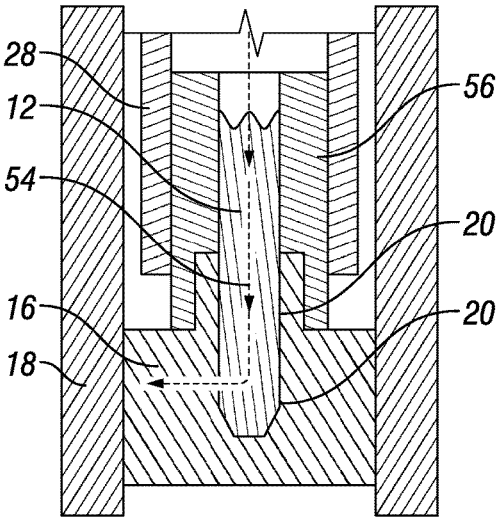
FIGS. 2A-2C are sectional views of different positions of the thermostat shown in FIG. 1.
Figure 2B:
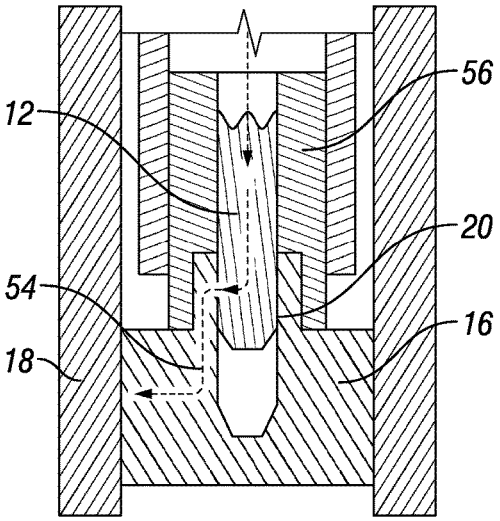
Figure 2C:
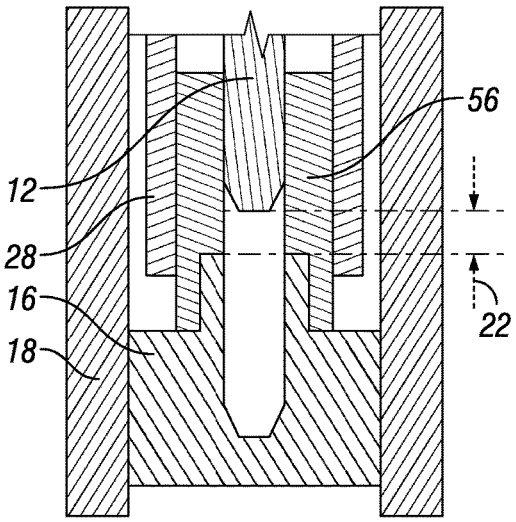

In some embodiments, the second solid thermal conductor 12 may optionally be movable to a third position as illustrated in FIG. 2B, which may be any intermediate position between the first position illustrated in FIG. 2A and the second position illustrated in FIG. 2C. In the third position, the second solid thermal conductor 12 may still be in contact with the first solid thermal conductor 16. However, the contact surface 20 of the second solid thermal conductor 12 with the first solid thermal conductor 16 in the third position has a second non-zero area that may be smaller than the first non-zero area. Thus, an area of the contact surface 20 of the second solid thermal conductor 12 with the first solid thermal conductor 16 may increase gradually with a change of position of the second solid thermal conductor 12 relative to the first solid thermal conductor 16. Such embodiments may allow a finer control of the thermal coupling between the second solid thermal conductor 12 and the first solid thermal conductor 16, and ultimately a finer control of the rate or amount of heat transferred between the component 14 located in the cavity 32 of the flask 28 and the environment of the elongated pressure housing 18.

The actuator 24 may be implemented with a thermal actuator including a sealed wax charge and a piston, or an equivalent thereof. Thermal actuators are compact, rugged, and do not require a separate power source. They are able to rapidly transform heat energy into piston driving mechanical energy, by using the thermal expansion of a sealed wax charge. Some known thermal actuators operate at specified temperatures up to 300° F. (150° C.) and provide a stroke up to 0.350" (9.0 mm). Thermal actuators are adapted to move in response to the temperature of the sealed wax charge. In this example, because both the actuator 24 and the component 14 are located in the cavity 32 of the flask 28, the temperatures of the actuator 24, the cavity 32, and the component 14 may be considered to be equivalent. Therefore, when the actuator 24 shown in FIG. 1 is implemented with a thermal actuator, the actuator 24 may also be described as adapted to move in response to the temperature of component 14, or to the temperature of the cavity 32.

Figure 3:
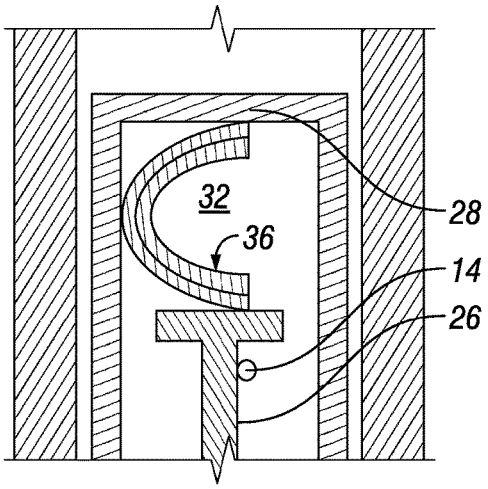
FIG. 3 is a sectional view of an actuator portion of a thermostat.

Turning to FIG. 3, a portion of another embodiment of the downhole tool 10 is illustrated. In this embodiment, the actuator may be implemented with a bimetallic strip 36 that is attached between the chassis 26 and the flask 28. The bimetallic strip is adapted to move in response to the temperature of its components. Again in this example, because both the bimetallic strip 36 and the component 14 are located in the cavity 32 of the flask 28, the temperatures of the bimetallic strip 36, the cavity 32, and the component 14 may be considered to be equivalent.

In other embodiments, the actuator may alternatively be implemented with a thermally expandable material, or a shape-memory material that is adapted to move the second solid thermal conductor 12 relative to the first solid thermal conductor 16 in response to the temperature of the material. As long as the actuator is not thermally insulated from the component 14 (e.g., the actuator and the component 14 are located in the flask 28), the temperature of the material forming the actuator may be considered equivalent to the temperature of component 14.

In cases where the actuator provides a motive force only when extending above a certain temperature (i.e., the actuator only provides a push force), a spring (not shown) may be used to bias the actuator to retract (i.e., the spring provides a pull force) when the temperature cools down.

Figure 4:
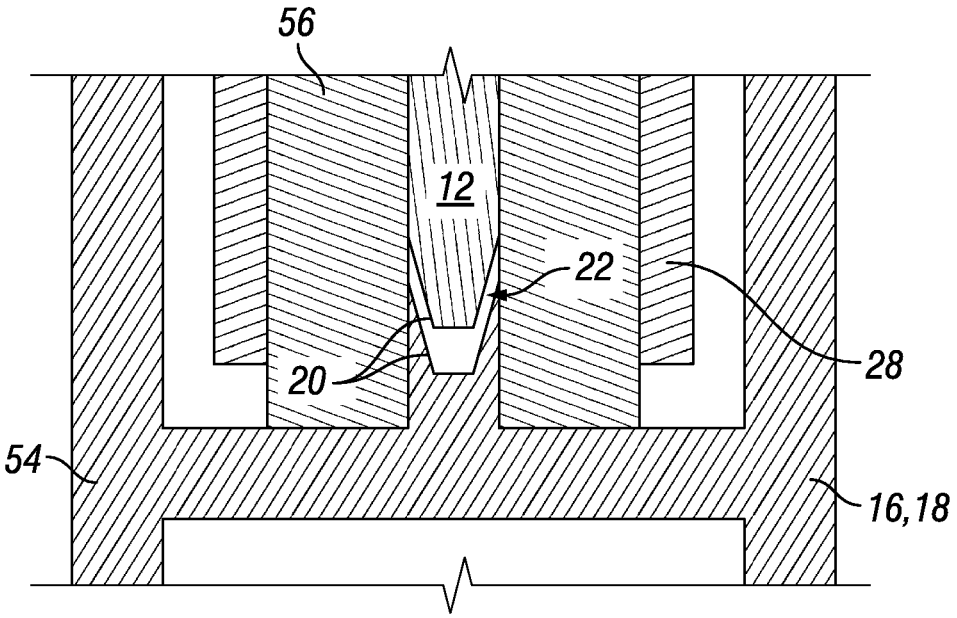
FIG. 4 is a sectional view of a thermal conductor portion of a thermostat.

Turning to FIG. 4, a portion of another embodiment of the downhole tool 10 is illustrated. In this embodiment, the first solid thermal conductor 16 is fixedly attached to, and even integral with, the elongated pressure housing 18. Also, the second solid thermal conductor 12 is not movable to a third position wherein the second solid thermal conductor 12 is still in contact with the first solid thermal conductor 16 and the contact surface 20 of the second solid thermal conductor 12 with the first solid thermal conductor 16 has an area intermediate between zero (i.e., no contact) and the full contact area. Thus, an area of the contact surface 20 of the second solid thermal conductor 12 with the first solid thermal conductor 16 goes from zero to the full contact area or the way around abruptly with a small change of position of the second solid thermal conductor 12 relative to the first solid thermal conductor 16. Such embodiment may be advantageous when a stroke of the actuator is limited. To increase the area of the contact surface 20 and the thermal conduction of the heat path 54 in the first position, the second solid thermal conductor 12 may preferably include a shallow, tapered nose sized to engage a corresponding cone formed in the first solid thermal conductor 16. A similar increase of the area of contact may alternatively be achieved by using shapes other than a tapered nose and/or by interchanging the locations of the nose and cone on the first and second solid thermal conductors.

Figure 5:
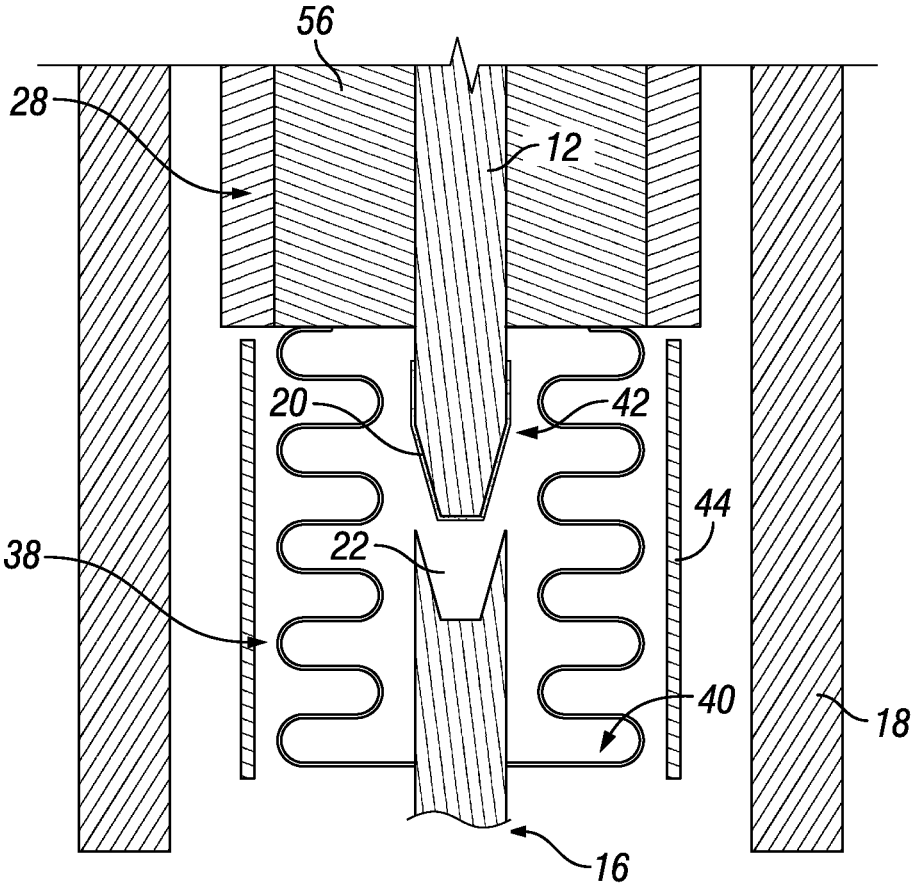
FIG. 5 is a sectional view of a thermal conductor portion of a thermostat including silver plating, metal bellows, and a reflective tube.

Turning to FIG. 5, a portion of another embodiment of the downhole tool 10 is illustrated, in which metal bellows 38 encase the contact surface 20 of the second solid thermal conductor 12 with the first solid thermal conductor 16 in a vacuum chamber 40. As such, heat convection or diffusion across the gap 22 separating the second solid thermal conductor 12 from the first solid thermal conductor 16 may be essentially suppressed. In cases where the actuator 24 is mechanically coupled to the first solid thermal conductor 16, the metal bellows 38 may be sufficiently flexible to allow movement of the first solid thermal conductor 16 into contact with the second solid thermal conductor 12. Further, the contact surface 20 of the second solid thermal conductor 12 with the first solid thermal conductor 16 may optionally include a silver plating 42. As such, heat radiation across the gap 22 separating the second solid thermal conductor 12 from the first solid thermal conductor 16 may be essentially suppressed.

Furthermore, the downhole tools may optionally comprise a reflective tube 44 surrounding the contact surface 20 of the second solid thermal conductor 12 with the first solid thermal conductor 16. As such, heat radiation from the elongated pressure housing 18 (or the wellbore environment) toward the second solid thermal conductor 12 may be essentially suppressed.

Figure 6:
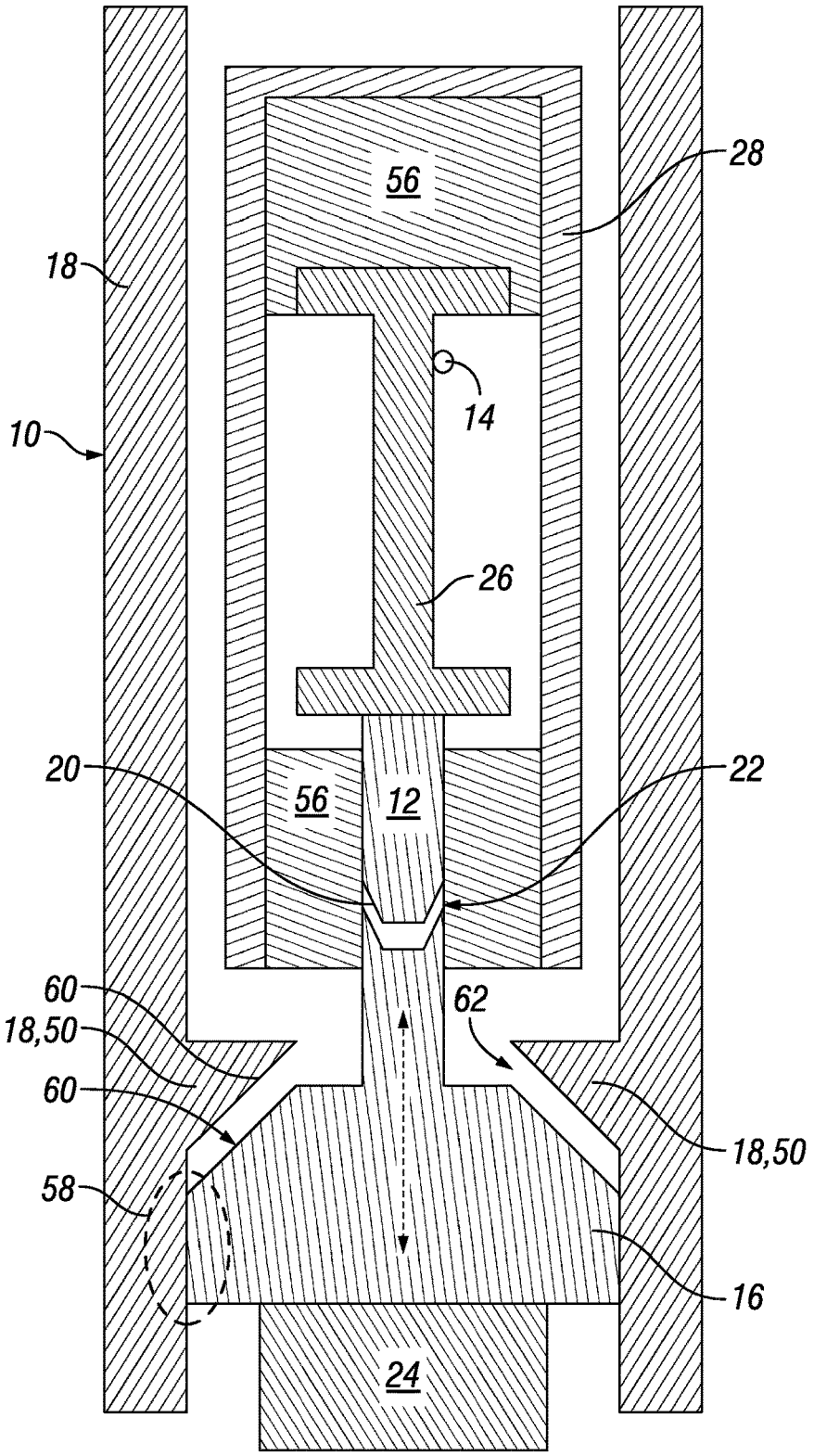
FIG. 6 is a sectional view of a downhole tool including a thermostat having an actuator at an alternative location.

Turning to FIG. 6, another embodiment of the downhole tool 10 is illustrated. In contrast with the embodiment illustrated in FIG. 1, the actuator 24 is mechanically coupled to the first solid thermal conductor 16. The first solid thermal conductor 16 is movable, and the actuator 24 is adapted to move the first solid thermal conductor 16 in response to temperature. Accordingly, the chassis 26 may remain stationary, which may be advantageous in cases where the component 14 or other components mounted on the chassis 26 shall not be moved, when electrical wires or mechanical linkages passing in and out of the flask 28 makes moving the chassis 26 difficult, or whenever moving the chassis 26 becomes difficult.

The actuator 24 may comprise a motor driven by a controller that is communicatively coupled to one or more temperature sensors. For example, the motor may be a linear motor, such as an electromechanical solenoid. Alternatively, the motor may be an electric rotating motor coupled to a lead screw. The motor may also be a pneumatic or hydraulic motor, including a piston piloted with one or more valves. The temperature sensors may measure a temperature TC that is equivalent to the temperature of the environment of the elongated pressure housing 18, and a temperature TH that is equivalent to the temperature of component 14 (e.g., a temperature anywhere inside the flask 28). Depending on the measured temperatures TC and TH, the actuator 24 may move the first solid thermal conductor 16 in a first position (not shown), wherein the first solid thermal conductor 16 is in contact with the second solid thermal conductor 12, or in a second position (as shown), wherein the first solid thermal conductor 16 is separated from the second solid thermal conductor 12 by a gap 22, either making or breaking thermal contact with the second solid thermal conductor 12. Also, because the second solid thermal conductor 12 is thermally coupled to the component 14 of the downhole tool 10 via the chassis 26 inside of the flask 28, and the first solid thermal conductor 16 is thermally coupled to an elongated pressure housing 18 of the downhole tools via direct thermal contact, the thermostat also allows or prevents heat inside the flask 28 at temperature TH from being conducted to the elongated pressure housing 18 and eventually to the environment (e.g., surrounding wellbore fluid) at temperature TC.

In this embodiment, the first solid thermal conductor 16 is also movable relative to the elongated pressure housing 18. Furthermore, the contact surface of the first solid thermal conductor 16 with the elongated pressure housing 18 may include a sliding portion 58 and an angled face 60. As such, a contact area of the first solid thermal conductor 16 with the elongated pressure housing 18 may increase gradually with a change of position of the first solid thermal conductor 16 relative to the elongated pressure housing 18. However, in other embodiments, the contact surface of the first solid thermal conductor 16 with the elongated pressure housing 18 may also include a cylindrical rod portion configured to snuggly reciprocate within a cylindrical cavity portion as illustrated in FIGS. 2A-2C.

In some cases, the sliding portion of the second contact surface 58 of the first solid thermal conductor 16 with the elongated pressure housing 18 may be insufficiently thermally conductive. Therefore, a third solid thermal conductor 50 that makes direct thermal contact with the elongated pressure housing 18, and in particular is integral with the elongated pressure housing 18, may be provided. Both the first solid thermal conductor 16 and the third solid thermal conductor 50 may include an angled face 60. Accordingly, the actuator 24 is adapted to move the first solid thermal conductor 16 relative to the second solid thermal conductor 12 and the third solid thermal conductor 50 between a first position and a second position in response to temperature. In the first position (not shown), the first solid thermal conductor 16 is in contact with the second solid thermal conductor 12 and the third solid thermal conductor 50. In the second position, the first solid thermal conductor 16 is separated from the second solid thermal conductor 12 by a gap 22 and from the third solid thermal conductor 50 by a second gap 62.

As the first solid thermal conductor 16 has two contact surfaces, contact surface 20 and angled face 60, the first solid thermal conductor 16 is preferably compliant at least near one of these areas to alleviate misalignment and/or tolerance stack up. For example, the first solid thermal conductor 16 may include compressed copper fibers, or dense copper sponge, that may form a gasket.

In other embodiments, the first solid thermal conductor 16 and the second solid thermal conductor 12 may form a single, solid thermal conductor that is thermally coupled to the component 14. This single thermal conductor is movable relative to the third solid thermal conductor 50, either in contact with the third solid thermal conductor 50, or separated from the third solid thermal conductor 50 by the second gap 62.

Figure 7:
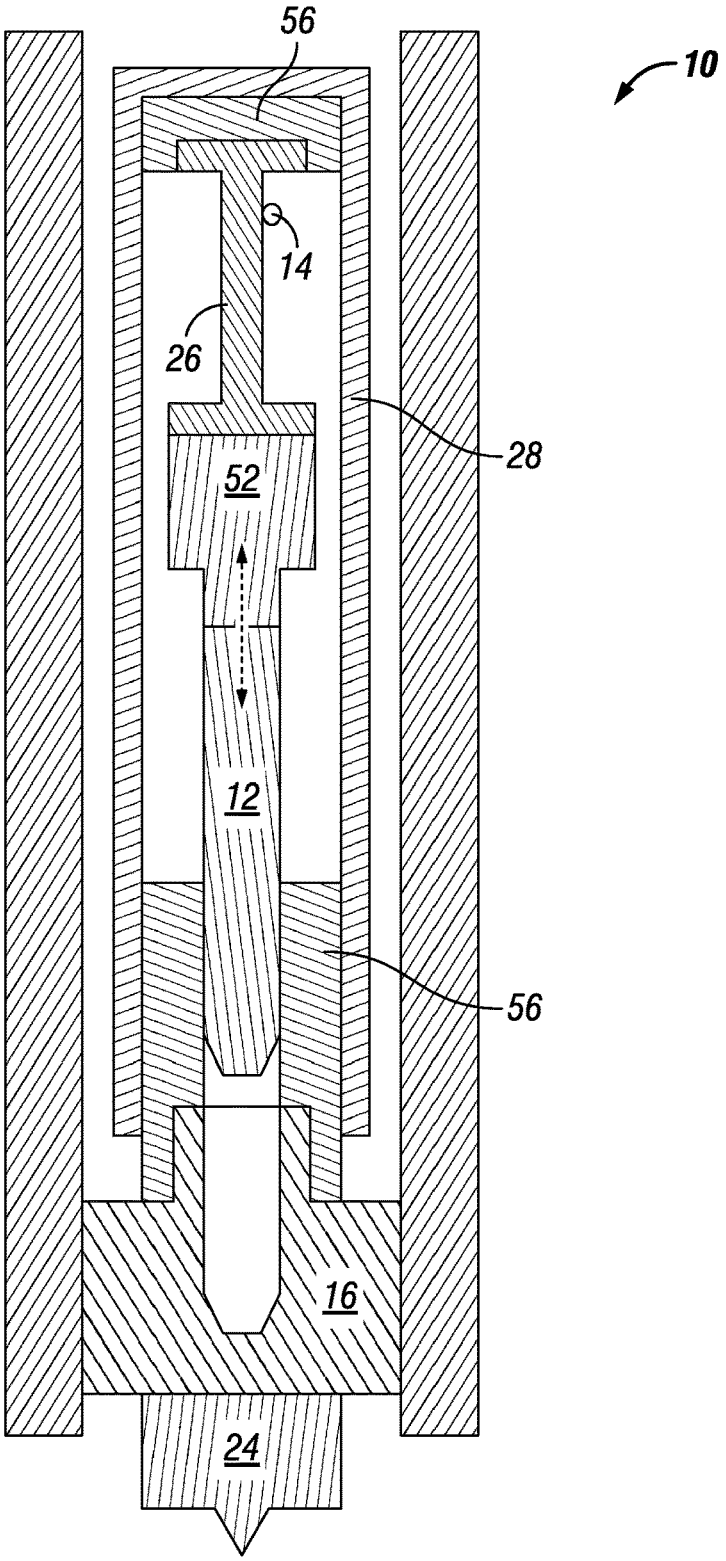
FIG. 7 is a sectional view of a downhole tool including a thermostat having one or more actuators at yet two alternative locations.

Turning to FIG. 7, another embodiment of the downhole tool 10 is illustrated. Two actuators are illustrated in FIG. 7: the actuator 24 and another actuator 52. In some embodiments, only the actuator 24 may be implemented. In other embodiments, only the other actuator 52 may be implemented. Optionally, both the actuator 24 and the other actuator 52 may be implemented. With the actuator 24 and/or the other actuator 52 located as shown in FIG. 7, the chassis 26 may remain stationary as the second solid 12 moves relative to the first solid thermal conductor 16.

As in FIG. 6, the actuator 24 is mechanically coupled to the first solid thermal conductor 16. The first solid thermal conductor 16 is movable, and the actuator 24 may be adapted to move the first solid thermal conductor 16 relative to a third solid thermal conductor (not shown) in response to temperature. The third solid thermal conductor may make direct thermal contact with the elongated pressure housing 18. In contrast with the embodiments of FIG. 6, the actuator 24 may be configured to move the first solid thermal conductor 16 toward the third solid thermal conductor only when a temperature TC that is equivalent to the temperature of the environment of the elongated pressure housing 18 is lower than a third predetermined temperature threshold. Accordingly, the first solid thermal conductor 16 may be efficiently thermally coupled to the environment of the elongated pressure housing 18 only when the environment of the elongated pressure housing 18 is sufficiently cold.

Alternatively, the third solid thermal conductor may be omitted (as shown). In such cases, the actuator 24 may be adapted to move the first solid thermal conductor 16 relative to the second solid thermal conductor 12 in response to temperature.

In addition or in replacement of the actuator 24, the downhole tools may comprise the other actuator 52. The other actuator 52 is mechanically coupled to the second solid thermal conductor 12. The other actuator 52 may be adapted to move the second solid thermal conductor 12 away from the first solid thermal conductor 16 in response to a temperature of the component 14 of the downhole tool 10 being lower than a second predetermined threshold. Accordingly, the component 14 may be at least partially insulated from the first solid thermal conductor 16 when the component 14 is sufficiently cold. However, the other actuator 52 may also be adapted to move the second solid thermal conductor 12 toward the first solid thermal conductor 16 in response to a temperature of component 14 of the downhole tool 10 exceeding a first predetermined threshold.

In contrast with the embodiment illustrated in FIG. 1, the other actuator 52 may be located between the chassis 26 and the second solid thermal conductor 12. In this configuration, the other actuator 52 moves the second solid thermal conductor 12, but the chassis 26 may stay stationary. This configuration may again lessen the complexity of the design of the chassis 26: Thus, electrical wires attached between the chassis 26 and other components of the downhole tool 10 located outside the flask 28 may not need to flex when the other actuator 52 moves the second solid thermal conductor 12. However, in this configuration, the other actuator 52 is preferably thermally conductive to conduct heat from the component 14, through the chassis 26, and into the second solid thermal conductor 12.

The actuator 24 and the other actuator 52 may both be implemented with thermal actuators including a sealed wax charge and a piston.

As mentioned previously, the first solid thermal conductor 16 may be thermally coupled to the environment, the actuator 24 may be omitted, and only the other actuator 52 may be implemented.

The downhole tools described herein may be used for dissipating heat buildup in the component 14 and/or in the flask 28 into the environment. They may be used for cooling the component 14 and/or the inside of the flask 28 when the environment is at a cooler temperature than the inside of the flask 28. They may be used for preventing heat flow into the component 14 and/or the flask 28 when the environment is at a hotter temperature than the inside of the component 14 and/or the flask 28. They may also be used for preventing heat flow out of the component 14 and/or the flask 28 when the environment is at a colder temperature than the component 14 and/or the inside of the flask 28.

In cases where the component 14 located inside the flask 28 has a maximum temperature limitation, the downhole tools described herein may be used for preventing the temperature of component 14 to exceed the maximum temperature limitation. There also are cases where the component 14 located inside the flask 28 has a minimum temperature limitation, where they may be used for preventing the temperature of component 14 from dropping below the minimum temperature limitation. Thus they may be used to regulate the temperature of component 14 located inside the flask 28 without a means of actively cooling.

Figure 8:
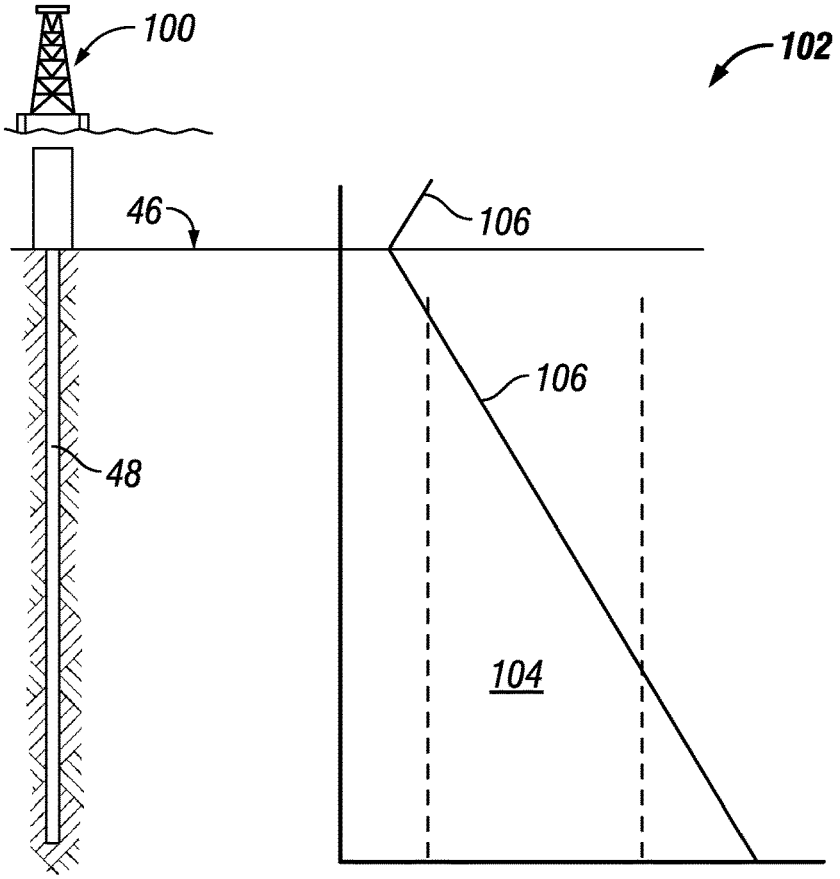
FIG. 8 is a schematic of a rig site and a temperature-depth graph shown side by side.

Turning to FIG. 8, a rig site 100 and a temperature-depth graph 102 are shown side by side to illustrate an example use of the downhole tools described herein. Abscissa in the graph 102 represents temperature and ordinate represents depth. In this example, the downhole tools may be wireline tools; the component may include a gyroscope that needs to remain at a temperature between 70 deg. F. and 260 deg. F. This temperature range is shown as area 104 in the temperature-depth graph 102. The wellbore 48 may be located offshore, in a cold climate. The rig floor may be at a temperature of 50 deg. F., the seafloor 46 at a temperature of 40 deg. F. and the bottom of the wellbore 48 may be at a temperature of 350 deg. F. A curve 106 of the environment temperature as a function of location is shown on the temperature-depth graph 102.

Referring to FIGS. 1-7 together with FIG. 8, the downhole tool 10 may be assembled by performing the steps of thermally coupling a second solid thermal conductor 12 to the gyroscope, thermally coupling a first solid thermal conductor 16 to an elongated pressure housing 18 of the downhole tools, and mechanically coupling an actuator 24 to at least one of the second solid thermal conductor 12 and the first solid thermal conductor 16. In situations such like these, the gyroscope is often placed in the flask 28, and the downhole tool 10, including the gyroscope and the flask 28, is preheated, for example to a temperature of approximately 100 deg. F. The gyroscope is then turned on, and calibrated before going into the wellbore 48.

The downhole tool 10 may then be tripped in the wellbore 48 while maintaining the gap 22 separating the second solid thermal conductor 12 from the first solid thermal conductor 16, with the gyroscope left running while tripping the downhole tool 10 into the wellbore 48. The gap 22 and the flask 28 may be used to prevent the heat inside the flask 28 from escaping into the environment and thus keeps the gyroscope at the temperature of 100 deg. F. or slightly warmer during the trip to the seafloor 46 and beyond.

When the downhole tool 10 reaches the bottom of the wellbore 48, the gyroscope is used to survey the wellbore 48 while the downhole tool 10 is slowly tripped out. While in use, the gyroscope or electronics in the flask 28 heats up. Typically, the gyroscope and electronics may continuously dissipate 10 W of electrical energy into heat inside the flask 28. At some point during the tripping out of the wellbore 48, but before the end of the survey, the gyroscope may reach its maximum temperature limitation of 260 deg. F. (e.g., the first predetermined temperature threshold in this example). At this point, the downhole tool 10 may be rapidly tripped to a location near a seafloor 46 (which is a location along the wellbore 48 where the environment of the elongated pressure housing 18 is usually the coldest), without surveying the wellbore 48. Then, using the actuator 24, the second solid thermal conductor 12 is moved into contact with the first solid thermal conductor 16. Accordingly, heat is dissipated out of the flask 28 into the environment and the temperature in the flask 28 decreases.

Preferably, the gap 22 separating the second solid thermal conductor 12 from the first solid thermal conductor 16 is reestablished before the flask 28 reaches the temperature of 70 deg. F. (e.g., the second predetermined temperature threshold in this example). The downhole tool 10 is then tripped back down to the last survey point for the survey to continue. During the trip in the wellbore 48, the inside of the flask 28 is insulated from the environment, thus preventing heat from the environment from flowing into the flask 28 when the environment becomes hotter than inside the flask 28. This process can be repeated until the complete wellbore 48 is surveyed. Accordingly, the temperature of the gyroscope may be maintained in a suitable range where the gyroscope may operate optimally. Note that the downhole tool 10 is not required to be tripped out of the wellbore 48 to either cool down the flask 28 or replace the flask 28 with a precooled backup flask.

In an alternative use, the downhole tool 10 may stay stationed near the seafloor 46 or in a seafloor 46 shallow well for an extended period of time, such as several days, where cold seawater is constantly flowing over the downhole tool 10. Alternatively, cold seawater may be circulated in the wellbore 48 about the downhole tool 10 (e.g., along the elongated pressure housing 18), such as when the downhole tool 10 is a drilling tool. For example, the cold seawater may be at a temperature of approximately 40 deg. F.

Because of the continuous dissipation inside the flask 28, the gyroscope, and/or electronics in the flask 28 heats up. By closing the gap 22 before the temperature inside the flask 28 exceeds 260 deg. F., the actuator 24 thermally connects the inside of the flask 28 with the environment selectively, allowing the heat inside the flask 28 to dissipate into the environment before the gyroscope reaches the temperature of 260 deg. F. As heat dissipates from the cavity 32 in the flask 28, the gyroscope, and/or electronics in the flask 28 cools down. By opening the gap 22 before the temperature inside the flask 28 becomes lower than 70 deg. F., the actuator 24 thermally disconnects the inside of the flask 28 from the environment thus stopping the transfer of heat from inside the flask 28 to the environment. Now the inside of the flask 28 may again slowly warm up because of the continuous heat dissipation inside the flask 28, and the process may be repeated. As such, the temperature of the gyroscope may again be maintained in the temperature range between 70 deg. F. and 260 deg. F. where the gyroscope operates optimally.

Figure 9:
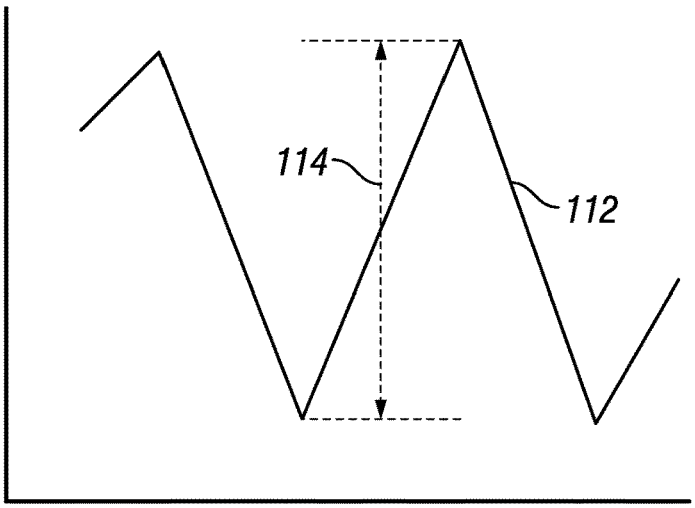
FIG. 9 is a graph of the temperature of a downhole tool component as a function of time.

Turning to FIG. 9, a graph representing a curve 112 of the temperature of component 14 as a function of time is illustrated. Abscissa in the graph illustrated in FIG. 9 represents time, and ordinate represents temperature. A swing amplitude 114 of the curve 112 usually depends on the predetermined first temperature threshold and second temperature threshold.

Referring to FIGS. 1-7 together with FIG. 9, gradually varying the area of the contact surface 20 of the second solid thermal conductor 12 with the first solid thermal conductor 16 may also be used to reduce the swing amplitude 114. Accordingly, the temperature of component 14 may be more finely adjusted. For example, the gradual variation of the area of the contact surface 20 exemplified in FIGS. 2A, 2B and 2C may allow finer control over the amount of heat either transferred into or out of the flask 28 than the stepwise variation of the area of the contact surface 20 exemplified in FIG. 4.

While the disclosure is susceptible to various modifications and alternative forms, specific embodiments thereof are shown by way of example in the drawings and description. It should be understood, however, that the drawings and detailed description thereto are not intended to limit the claims to the particular form disclosed, but on the contrary, the intention is to cover all modifications, equivalents, and alternatives falling within the scope of the claims.

What is claimed is:

1. A downhole tool, comprising:

a first solid thermal conductor thermally coupled to an elongated pressure housing of the downhole tool, a second solid thermal conductor thermally coupled to a component of the downhole tool;

one of the second solid thermal conductor and the first solid thermal conductor being movable relative to the other of the second solid thermal conductor and the first solid thermal conductor in:

a first position, wherein the second solid thermal conductor and the first solid thermal conductor are in contact and a contact surface between the second solid thermal conductor and the first solid thermal conductor in the first position has a first non-zero area, a second position, wherein the second solid thermal conductor and the first solid thermal conductor are separated by a gap, and a third position, wherein the second solid thermal conductor and the first solid thermal conductor are in contact, wherein the contact surface between the second solid thermal conductor and the first solid thermal conductor in the third position has a second non-zero area that is smaller than the first non-zero area; and an actuator mechanically coupled to the one of the second solid thermal conductor and the first solid thermal conductor, the actuator being adapted to move the one of the second solid thermal conductor and the first solid thermal conductor relative to the other of the second solid thermal conductor in the first position, the second position, and the third position in response to temperature.

2. The downhole tool of claim 1, wherein the second solid thermal conductor is fixedly attached to a chassis on which the component of the downhole tool is mounted.

3. The downhole tool of claim 1, wherein the first solid thermal conductor is fixedly attached to the elongated pressure housing of the downhole tool.

4. The downhole tool of claim 1, the first solid thermal conductor being further movable relative to the elongated pressure housing.

5. The downhole tool of claim 4, wherein an area of a contact surface of the first solid thermal conductor with the elongated pressure housing increases with a change of position of the first solid thermal conductor relative to the elongated pressure housing.

6. The downhole tool of claim 1, further comprising:

a flask disposed in the elongated pressure housing, the flask having an opening and a cavity, the component being disposed in the cavity of the flask, and the second solid thermal conductor being disposed at least partially in the opening of the flask.

7. The downhole tool of claim 1, further comprising:

a flask disposed in the elongated pressure housing, the flask having an opening and a cavity, the component being disposed in the cavity of the flask, and the first solid thermal conductor being disposed at least partially in the opening of the flask.

8. The downhole tool of claim 1, wherein the contact surface of the second solid thermal conductor with the first solid thermal conductor includes a silver plating.

9. The downhole tool of claim 1, wherein the contact surface of the second solid thermal conductor with the first solid thermal conductor includes means for essentially suppressing heat radiation across the gap separating the second solid thermal conductor from the first solid thermal conductor.

10. A downhole tool, comprising:

a first solid thermal conductor thermally coupled to an elongated pressure housing of the downhole tool, a second solid thermal conductor thermally coupled to a component of the downhole tool;

one of the second solid thermal conductor and the first solid thermal conductor being movable relative to the other of the second solid thermal conductor and the first solid thermal conductor in:

a first position, wherein the second solid thermal conductor and the first solid thermal conductor are in contact and a contact surface between the second solid thermal conductor and the first solid thermal conductor in the first position has a first non-zero area, and a second position, wherein the second solid thermal conductor and the first solid thermal conductor are separated by a gap; and an actuator mechanically coupled to the one of the second solid thermal conductor and the first solid thermal conductor, wherein the actuator comprises a motor driven by a controller that is communicatively coupled to one or more temperature sensors, an electromechanical solenoid, a piston piloted with valves, a thermal actuator including a sealed wax charge and a piston, a thermally expandable material, a shape-memory material, or a bimetallic strip, the actuator being adapted to move the one of the second solid thermal conductor and the first solid thermal conductor relative to the other of the second solid thermal conductor in the first position and the second position in response to temperature.

11. A downhole tool, comprising:

a first solid thermal conductor thermally coupled to an elongated pressure housing of the downhole tool, a second solid thermal conductor thermally coupled to a component of the downhole tool;

one of the second solid thermal conductor and the first solid thermal conductor being movable relative to the other of the second solid thermal conductor and the first solid thermal conductor in:

a first position, wherein the second solid thermal conductor and the first solid thermal conductor are in contact and a contact surface between the second solid thermal conductor and the first solid thermal conductor in the first position has a first non-zero area, and a second position, wherein the second solid thermal conductor and the first solid thermal conductor are separated by a gap;

an actuator mechanically coupled to the one of the second solid thermal conductor and the first solid thermal conductor, the actuator being adapted to move the one of the second solid thermal conductor and the first solid thermal conductor relative to the other of the second solid thermal conductor in the first position and the second position in response to temperature; and metal bellows encasing the contact surface between the second solid thermal conductor and the first solid thermal conductor in a vacuum chamber.

12. A downhole tool, comprising:

a first solid thermal conductor thermally coupled to an elongated pressure housing of the downhole tool, a second solid thermal conductor thermally coupled to a component of the downhole tool;

one of the second solid thermal conductor and the first solid thermal conductor being movable relative to the other of the second solid thermal conductor and the first solid thermal conductor in:

a first position, wherein the second solid thermal conductor and the first solid thermal conductor are in contact and a contact surface between the second solid thermal conductor and the first solid thermal conductor in the first position has a first non-zero area, and a second position, wherein the second solid thermal conductor and the first solid thermal conductor are separated by a gap;

an actuator mechanically coupled to the one of the second solid thermal conductor and the first solid thermal conductor, the actuator being adapted to move the one of the second solid thermal conductor and the first solid thermal conductor relative to the other of the second solid thermal conductor in the first position and the second position in response to temperature; and a reflective tube surrounding the contact surface of the second solid thermal conductor with the first solid thermal conductor.

13. A downhole tool, comprising:

a first solid thermal conductor;

a second solid thermal conductor thermally coupled to a component of the downhole tool;

a third solid thermal conductor thermally coupled to an elongated pressure housing of the downhole tool, the first solid thermal conductor being movable relative to the second solid thermal conductor and the third solid thermal conductor between a first position wherein the first solid thermal conductor is in contact with the second solid thermal conductor and the third solid thermal conductor, and a second position, wherein the first solid thermal conductor is at least partially separated from the second solid thermal conductor by a first gap and from the third solid thermal conductor by a second gap, and an actuator mechanically coupled to the first solid thermal conductor, the actuator being adapted to move the first solid thermal conductor relative to the second solid thermal conductor and the third solid thermal conductor between the first position and the second position in response to temperature.

14. The downhole tool of claim 13, further comprising an other actuator mechanically coupled to the second solid thermal conductor, the other actuator being adapted to move the second solid thermal conductor relative to the first solid thermal conductor in response to a temperature of the component of the downhole tool.

* * * * *